US005162015A

United States Patent [19]

Otani

[11] Patent Number: 5,162,015

[45] Date of Patent: Nov. 10, 1992

[54] BACKLESS BUST-SUPPORTING UNDERGARMENT

[75] Inventor: Carol Otani, Los Angeles, Calif.

[73] Assignee: Warnaco, Inc., New York, N.Y.

[21] Appl. No.: 765,586

[22] Filed: Sep. 25, 1991

[51] Int. Cl.[5] ..... A41C 3/12; A41F 1/00; A41F 1/04; A41F 17/00

[52] U.S. Cl. ..... 450/7; 450/12; 450/15; 450/16; 450/22; 450/27; 450/49; 2/67; 2/73; 2/109

[58] Field of Search ..... 2/67, 73, 109, 110; 450/1, 7, 12, 15, 16, 22, 23, 27, 30, 48, 49, 155

[56] References Cited

U.S. PATENT DOCUMENTS

| | | | |
|---|---|---|---|
| 933,610 | 9/1909 | Yanowsky | 450/15 |
| 1,694,693 | 12/1928 | Ulman . | |
| 1,904,451 | 4/1933 | Earnshaw | 2/67 |
| 1,954,526 | 4/1934 | Holahan | 2/67 |
| 2,050,064 | 8/1936 | Neal | 450/30 X |
| 2,056,773 | 10/1936 | Dann . | |
| 2,060,689 | 11/1936 | Read | 2/67 |
| 2,060,998 | 11/1936 | Martin | 450/27 X |
| 2,102,363 | 12/1937 | Kugler | 2/67 |
| 2,201,662 | 5/1940 | De Luco . | |
| 2,429,767 | 10/1947 | Oliensis | 450/7 |
| 2,451,300 | 10/1948 | Neal | 2/406 |
| 2,463,319 | 3/1949 | Schwartz . | |
| 2,480,049 | 8/1949 | Rosenberg . | |
| 2,561,783 | 7/1951 | Burr | 450/16 |
| 2,567,442 | 9/1951 | Mitchell | 2/67 |
| 2,651,780 | 9/1953 | Miller | 2/67 |
| 3,252,460 | 5/1966 | Lances | 450/49 |
| 3,273,563 | 9/1966 | Bonang | 450/155 |
| 3,292,629 | 12/1966 | Steinberger . | |
| 3,320,959 | 5/1967 | Fridolph . | |
| 3,411,508 | 11/1968 | Sayers | 450/27 X |
| 3,422,818 | 1/1969 | Erteszek | 2/73 X |
| 3,465,754 | 9/1969 | Lockwood et al. | 450/1 |
| 3,913,146 | 10/1975 | Zero . | |
| 4,073,299 | 2/1978 | Murata | 450/1 |
| 4,597,110 | 7/1986 | Smith, Sr. et al. . | |
| 4,635,640 | 1/1987 | Sehorn | 2/67 X |
| 4,656,669 | 4/1987 | Beard | 2/67 |
| 4,698,847 | 10/1987 | Yoshihara . | |
| 4,815,145 | 3/1989 | Chow | 2/67 |
| 4,952,192 | 8/1990 | Burke . | |
| 4,983,140 | 1/1991 | Gimble . | |

FOREIGN PATENT DOCUMENTS

| | | | |
|---|---|---|---|
| 0111341 | 11/1928 | Austria | 450/15 |
| 0488237 | 7/1938 | United Kingdom | 2/42 |

*Primary Examiner*—Werner H. Schroeder
*Assistant Examiner*—Jeanette E. Chapman
*Attorney, Agent, or Firm*—Amster, Rothstein & Ebenstein

[57] ABSTRACT

An undergarment affording bust support and an unobstructed view of the wearer's back including a panty portion, a bra portion and joining straps. The panty portion has a front panel, a rear panel, and fasteners for joining the front and rear panels together at the crotch. The bra portion has a pair of cups, a connector joining the cups at the front, and, for each cup, a shoulder strap for supporting the cup on a respective shoulder of the wearer. On each side, the joining straps are a first strap joining the rear panel and a respective one of the cups and a second strap joining the front panel and a respective one of the shoulder straps. The first and second joining straps cross and are secured together adjacent a respective one side of the wearer, preferably at about waist level.

14 Claims, 3 Drawing Sheets

BACKLESS BUST-SUPPORTING UNDERGARMENT

BACKGROUND OF THE INVENTION

The present invention relates to undergarments affording bust support and an unobstructed view of the wearer's back, and more particularly to such undergarments including a panty portion, a bra portion, and straps connecting the two portions.

Undergarments including bra and panty portions are well known in the undergarment art. Typically the bra portion includes straps which extend behind the wearer's neck or laterally across the back of the wearer in order to provide a desired level of bust support. Such straps extending either behind the neck of the wearer or behind the back of the wearer are believed to be necessary in order to provide the bust of the wearer with an acceptable level of support. Such an undergarment is acceptable for many purposes, but not where a backless or peek-a-boo back dress is to be worn over it since the undergarment does not afford an unobstructed view of the wearer's back (as intended by a backless dress) and tends to peek through a peek-a-boo back dress.

While off-the-shoulder bras are also known in the undergarment art, they are considered neither to be particularly comfortable (as the straps tend to slide down the wearer's arms since there is no laterally extending strap across the wearer's back to secure the shoulder straps together) nor to display a desirably high level of bust support Indeed, where a strap descends on the wearer's arm, the bottom of the bra cup may become displaced from the wearer's torso, with the result that the base of the breast receives no substantial support and may even slip below the cup.

Accordingly, it is an object of the present invention to provide an undergarment having bra and panty portions which affords both a high level of bust support and an unobstructed view of the wearer's back.

Another object is to provide such an undergarment which is suitable for use with backless and peek-a-boo back dresses.

A further object is to provide such an undergarment wherein the bra and panty portions are connected by straps which promote appropriate positioning of the bra portion on the wearer.

It is another object of the present invention to provide such an undergarment wherein the straps connecting the bra and panty portions on each side cross and are secured together at about waist level of the wearer.

It is a further object is to provide such an undergarment which is of simple and economical construction, easy to put on and take off, and comfortable to wear.

SUMMARY OF THE INVENTION

It has now been found that the above and related objects of the present invention are obtained in an garment affording bust support and an unobstructed view of the wearer's back comprising a panty, a bra and, on each side, means joining the bra and panty. The panty includes a front panel and a rear panel. The bra includes a pair of cups means joining the bra cups at the front, and straps for supporting the bra on a respective shoulder of the wearer. On each side, first means join the rear panel and a respective one of the cups and second means join the front panel and a respective one of the straps. The first and second means cross and are secured together adjacent a respective one side of the wearer.

Preferably the garment is an undergarment, includes means for securing the front and rear panels of the panty together at the crotch, and has each bra strap supports a respective one of the bra cups on a respective shoulder of the wearer.

In a preferred embodiment, the bra includes a pair of structural support wires, each of the wires extending around the bottom of a respective one of the cups. The bra is devoid of any laterally extending means securing the cups together across the back of the wearer above the waist. The first and second means cross and are secured together adjacent a respective one side of the wearer only at about waist level.

In another preferred embodiment, each of the first andsecond means have spaced apart longitudinal edges and a bight portion between the longitudinal edges, the first and second means being joined together along each longitudinal edge where the longitudinal edges cross. The first and second means define a generally rectangular interconnection therebetween The bight portion of the first means extends across the rectangular interconnection, but the bight portion of the second means does not.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF PREFERRED EMBODIMENTS

Figure 1:
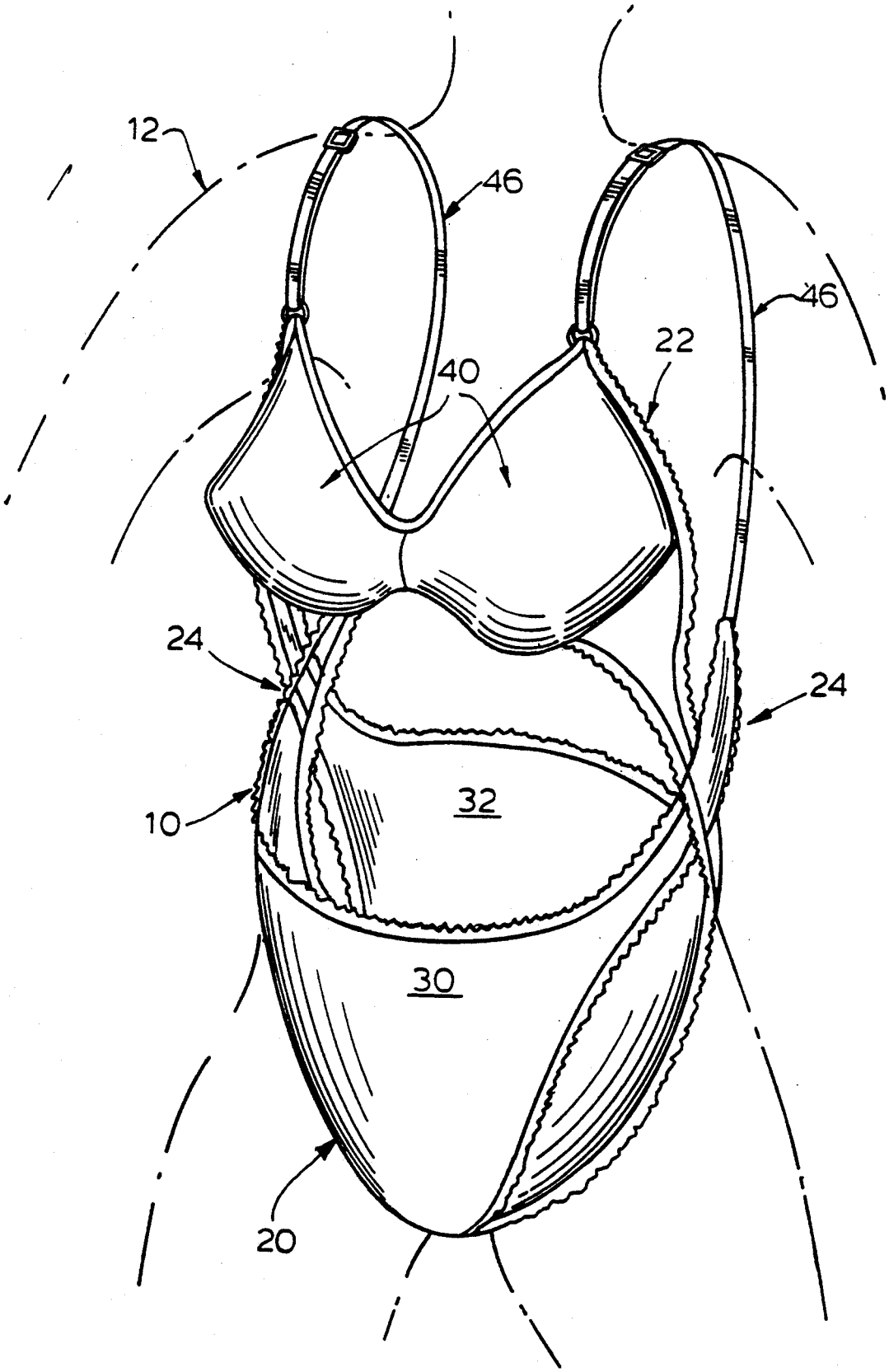
FIG. 1 is an isometric view of an undergarment according to the present invention worn by a female.

Referring now to the drawing, and in particular to FIG. 1 thereof, therein illustrated is an undergarment according to the present invention, generally designated by the reference numeral 10, worn by a female 12. More particularly, the undergarment 10 comprises a panty generally designated 20, a bra generally designated 22, and, on each side, joining means, generally designated 24, joining the bra 22 and panty 20.

Referring now to FIGS. 2-5 as well, the panty 20 includes a front panel 30, a rear panel 32, and means 34 for releasably fastening the front and rear panels 30, 32 together at the crotch. Such releasable fastening means 34 are well known in the undergarment art and may include metal or plastic snap fasteners (as illustrated), microloop-and-microhook members available under the tradename VELCRO, and the like. The releasable fastening means 34 facilitates the wearer performing various bodily functions without the necessity for removal of the garment as a whole (for example, for urination or evacuation). While the panty 20 illustrated has been cut high (i.e., with generally triangular panels 30, 32) to reveal a large expanse of outer thigh for aesthetic reasons, clearly other cuts are also suitable for the panty 20.

The panty panels 30, 32 may be made of any natural or synthetic fibers customarily used for panties, including silk, nylon, cotton, and the like. Where the material of the rear panel 32 is not porous, the upper portion of rear panel 32 may be formed substantially of the non-porous material with the lower or crotch portion thereof being formed of cotton or like porous material.

The bra 22 includes a pair of cups 40 (the cup illustrated on the left of FIG. 2 being cup 40*a* and the cup illustrated on the right thereof being cup 40*b*) and means 42 joining the cups at the front. Depending on the degree of lateral separation desired between the cups 40, the means 42 joining the cups at the front may simply be stitching or, where the cups are laterally spaced apart, a length of connecting material, each end of which is sewn to or integral with a respective cup 40. Indeed, if desired, the two cups 40 and the joining means 42 may be of integral one-piece construction, as in seamless molded bras.

Figure 3:
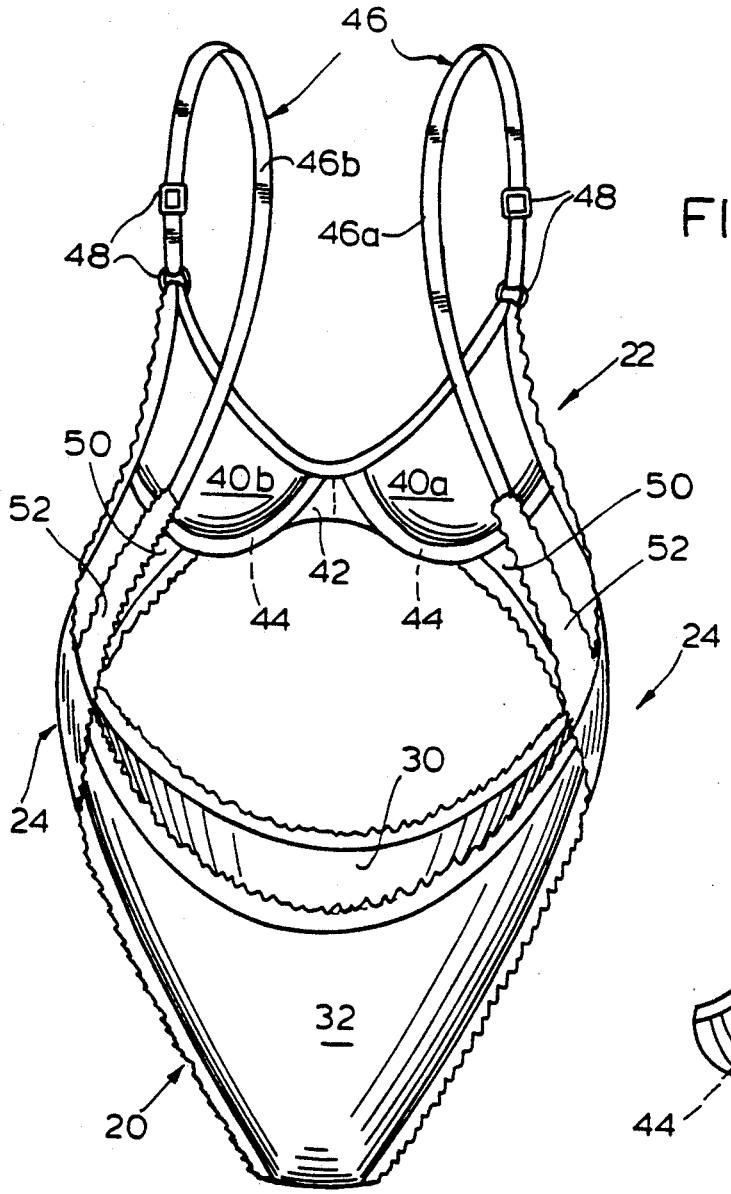
FIG. 3 is a back elevational view thereof.
Figure 5:
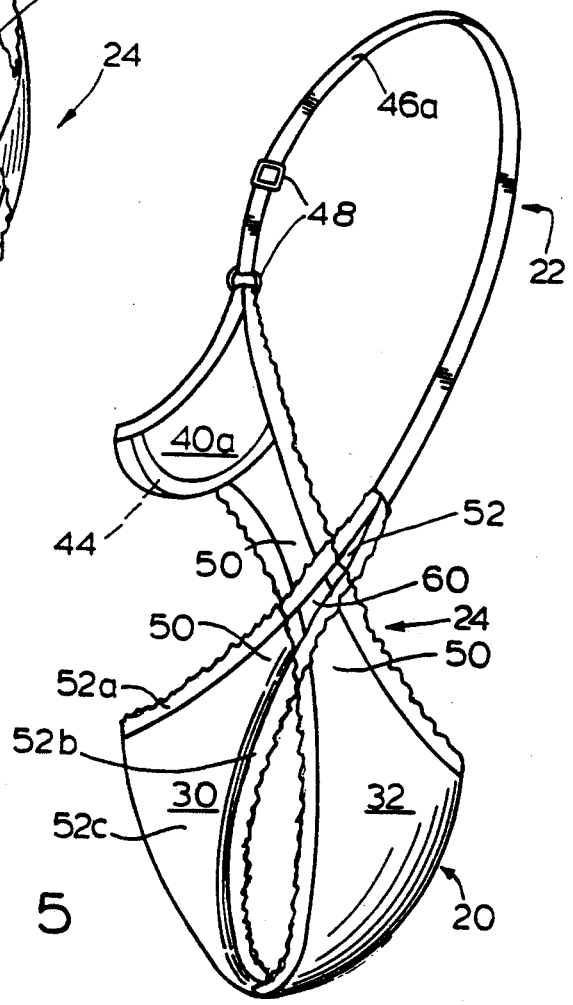
FIG. 5 is a side elevational view thereof taken along the line 5—5 of FIG. 2.

As best seen in FIGS. 3 and 5, each bra cup 40 preferably has a structural support wire 44 (commonly called an "underwire") extending around the bottom (including the sides) Typically, as is conventional in underwire bras, the underwire 44 is disposed within the cup 40 or wrapped in padding or cushioning material sewn onto the inner surface of the cup (as illustrated). In either case the underwire 44 is itself concealed and at least somewhat padded to minimize the discomfort otherwise caused thereby to the wearer.

The bra 22 is devoid of any laterally extending means securing the cups together across the back of the wearer above the waist. Each cup 40 is supported by its own shoulder strap 46. Thus, the cup 40*a* is supported on one shoulder of the wearer by strap 46*a*, while the cup 40*b* is supported on the other shoulder of the wearer by strap 46*b*. Each strap 46 is adjustable in length via an adjustment mechanism 48 of the type commonly found in the bra art for adjusting the length of a shoulder strap. The straps 46 provide a substantially unobstructed view of the wearer's back and thus permit the undergarment 10 of the present invention to be worn with a backless or peek-a-boo back dress, provided only that there is a dress strap extending across each shoulder of the wearer under which the strap 46 of the undergarment 10 may be positioned and thus concealed.

With the exception of the underwires 44 (and any cushioning therefor) and the length-adjustment mechanisms 48, the bra 22 is preferably formed of the same material as the panty panels 30, 32. It will be appreciated, of course, that, as is conventional in the art, lace-like coverings may be applied to the outer surface of the cups 40 to improve the aesthetic effect thereof, and cushioning or padding materials may be applied to the inner surface of the cups 40 either to enhance comfort or provide a desired fullness or shape thereto.

Figure 2:
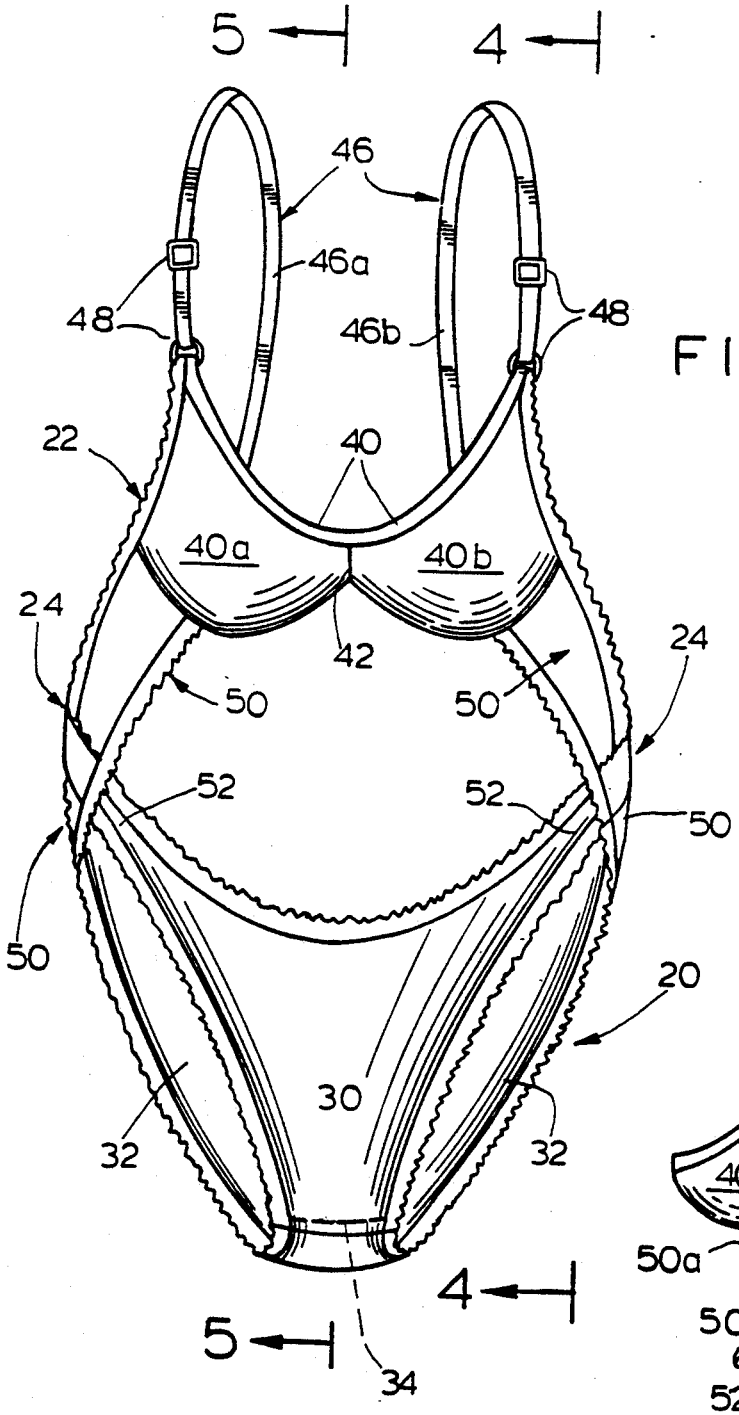
FIG. 2 is a front elevational view of the undergarment.

The means 24 joining the panty and bra 20, 22 on each side (as illustrated in FIGS. 2 and 3) include first strap means 50 joining the rear panel 32 and the respective one of the cups 40 on that side and second strap means 52 joining the front panel 30 and the respective one of the shoulder straps 46 on that side. The first and second strap means 50, 52 cross and are secured together adjacent that side of the wearer, preferably at about waist level. For example, the first and second strap means 50, 52 may be secured together by stitching, with the intersection or interconnection between the strap means 50, 52 being disposed only at about the level of the waist of the wearer.

Figure 4:
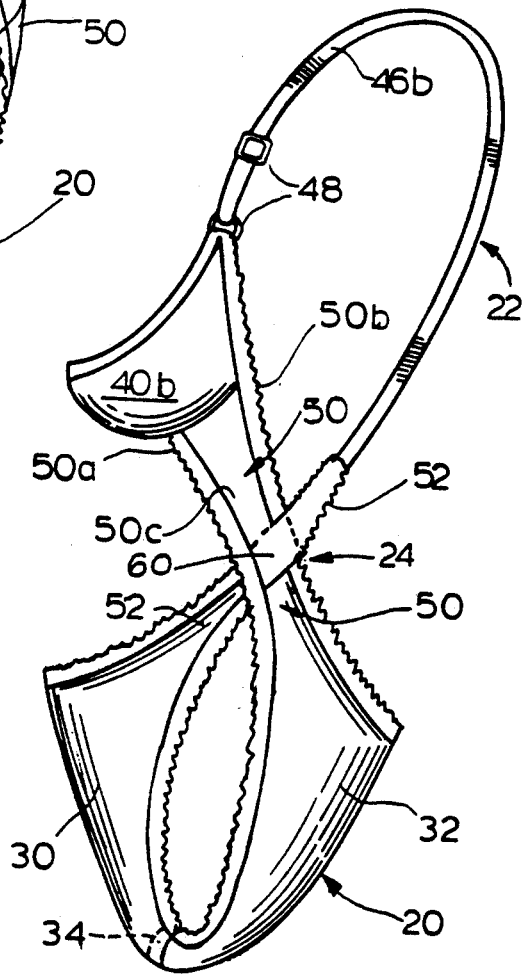
FIG. 4 is a side elevational view thereof taken along the line 4—4 of FIG. 2.

As best seen in FIGS. 4 and 5, in the preferred embodiment of the invention illustrated, each of the first and second strap means 50 and 52 have a spaced apart pair of longitudinal edges 50*a*, 50*b* and 52*a*, 52*b*, and a bight portion 50*c* and 52*c* between each pair of longitudinal edges. Typically the longitudinal edges are thicker than the bight portion and contain reinforcing elastic means. The first and second strap means 50, 52 are joined together along each longitudinal edge 50*a*, 50*b* and 52*a*, 52*b* where the longitudinal edges cross. Where the longitudinal edges cross, they define a generally rectangular interconnection 60. Preferably, the bight portion 50*c* of the first strap means 50 extends across the interconnection 60, while the bight portion 52*c* of the second straps means 52 does not extend across the interconnection 60, so that there is only a single thickness of bight portion in the center of the interconnection 60. Alternatively, however, each bight portion 50*c*, 52*c* may extend across the interconnection 60.

While the undergarment 10 has been described as having a panty 20, a bra 22, and joining means 24 on each side, typically the undergarment 10 will be basically of unitary one-piece integral construction with the various portions thereof sewn together as necessary or being formed from a single piece of material. Thus the first strap means 50 may have an upper end which is part of the bra cup 40 and a lower end which is part of the back panty panel 32, while the second strap means 52 may have an upper end which is part of the off-the-shoulder strap 46 and a lower end which is part of the front panty panel 30. Indeed, in the preferred embodiment of the present invention illustrated, the front and rear panels 30, 32 of the panty 20 are connected only at the crotch by the fastening means 34 and at the top by the two generally rectangular interconnections 60. Similarly, in the preferred embodiment of the present invention illustrated, each shoulder straps 46 is connected to its respective cup 40 at the top front of the cup and to the bottom front of the cup 40 only through the interconnection 60.

It will be appreciated that the garment is easily put on and taken off. To put on the undergarment 10, the wearer may simply step into it (with the releasable joining means 34 already fastened) and raise the shoulder straps 46 until they are disposed over her shoulders.

Preferably the panty panels 30, 32, the bra cups 40, the shoulder straps 46, and the joining means 50, 52 are formed of an elastic material providing a convenient and comfortable level of resiliency. When the undergarment 10 is worn, it provides a desirably high level of bust support while still affording an unobstructed view of the wearer's back. The weight or bulking of the wearer's posterior on the rear panty Panel 32 is transmitted by the joining strap means 50 through the interconnections 60 to the bra cups 40 in order to maintain the same close to the body torso, while the weight or bulking of the wearer's abdomen on the front panty panel 30 is transmitted by the joining strap means 52 through the interconnections 60 to the off-the-shoulder straps 46 in order to maintain the same in place on the shoulders of the wearer, thereby both supporting the bra cups 40 and making the undergarment comfortable to wear.

To summarize, the undergarment of the present invention affords both a high level of bust support and an unobstructed view of the wearer's back so that it is suitable for use with backless and peek-a-boo back dresses. The bra and Panty are directly connected by joining straps which appropriately position both the shoulder straps and cups of the bra on the wearer. The joining straps connecting the bra and panty on each side cross and are secured together at about waist level of the wearer. The undergarment is of a simple and economical construction, easy to put on and take off, and comfortable to wear.

Now that the preferred embodiments of the present invention have been shown and described in detail, various modifications and improvements thereon will become readily apparent to those skilled in the art. Accordingly, the spirit and scope of the present invention is to be construed broadly and in a manner consistent with the appended claims, and not limited by the foregoing specification.

I claim:

1. A garment comprising:

(A) a panty including a front panel and a rear panel;

(B) a bra including a pair of cups and straps for supporting the bra on the shoulders of the wearer; and (C) on each side of said panty and said bra, first means for joining said rear panel and a respective one of said cups and second means for joining said front panel and a respective one of said straps, said first and second means crossing and being secured together only at the intersection thereof adjacent a respective one side of the wearer;

said panty and bra being secured together exclusively by said first and second means.

2. The garment of claim 1 wherein said bra includes a pair of structural support wires, each of said wires extending around the bottom of a respective one of said cups.

3. The garment of claim 1 wherein said bra is devoid of any laterally extending means securing said cups together across the back of the wearer above the waist, and each of said straps supports a respective cup on a respective shoulder of a wearer.

4. An undergarment affording bust support and an unobstructed view of the wearer's back comprising:

(A) a panty including a front panel, a rear panel, and means for securing said front and rear panels together at the crotch;

(B) a bra including a pair of cups, means joining said cups at the front, and, for each cup, a shoulder strap for supporting the cup on a respective shoulder of the wearer; and (C) on each side of said panty and said bra, first means for joining said rear panel and a respective one of said cups and second means for joining said front panel and a respective one of said straps, said first and second means crossing and being secured together adjacent a respective one side of the wearer only at about waist level and only at the intersection thereof;

said panty and bra being secured together exclusively by said first and second means.

5. The undergarment of claim 4 wherein said bra includes a pair of structural support wires, each of said wires extending around the bottom of a respective one of said cups.

6. The undergarment of claim 4 wherein said bra is devoid of any laterally extending means securing said cups together across the back of the wearer above the waist.

7. The undergarment of claim 4 wherein said first and second means cross and are secured together adjacent a respective one side of the wearer only at about waist level.

8. An undergarment affording bust support and an unobstructured view of the wearer's back comprising:

(A) a panty including a front panel, a rear panel, and means for securing said front and rear panels together at the crotch;

(B) a bra including a pair of cups, means joining said cups at the front, and, for each cup, a shoulder strap for supporting the cup on a respective shoulder of the wearer; and (C) on each side of said panty and said bra, first means for joining said rear panel and a respective one of said cups and second means for joining said front panel and a respective one of said straps, said first and second means crossing and being secured together adjacent a respective one side of the wearer, each of said first and second means having spaced apart longitudinal edges and a bight portion between said longitudinal edges, said first and second means being joined together along each longitudinal edge where said longitudinal edges cross.

9. The undergarment of claim 8 wherein said first and second means define a generally rectangular interconnection therebetween.

10. The undergarment of claim 9 wherein said bight portion of said first means extends across said rectangular interconnection.

11. The undergarment of claim 10 wherein said bight portion of said second means does not extend across said rectangular connection.

12. An undergarment affording bust support and an unobstructed view of the wearer's back comprising:

(A) a panty including a front panel, a rear panel, and means for securing said front and rear panels together at the crotch;

(B) a bra including a pair of cups, means joining said cups at the front, and, for each cup, a shoulder strap for supporting the cup on a respective shoulder of the wearer and a structural support wire extending around the bottom of the cup, said bra portion being devoid of any laterally extending means securing said cups together across the back of the wearer above the waist; and (C) on each side of said panty and said bra, first means for joining said rear panel and a respective one of said cups and second means for joining said front panel and a respective one of said straps, said first and second means crossing and being secured together adjacent a respective one side of the wearer only at about waist level and only at the intersection thereof;

said panty and bra being secured together exclusively by said first and second means.

13. The undergarment of claim 12 wherein each of said first and second means have spaced apart longitudinal edges and a bight portion between said longitudinal edges, said first and second means being joined together along each longitudinal edge where said longitudinal edges cross, said first and second means defining a generally rectangular interconnection therebetween with said bight portion of said first means extending across said rectangular interconnection and said bight portion of said second means not extending across said rectangular interconnection.

14. A garment comprising:

(A) a panty including a front panel and a rear panel;

(B) a bra including a pair of cups and straps for supporting the bra on the shoulders of the wearer; and (C) on each side of said panty and said bra, first means for joining said rear panel and a respective one of said cups and second means for joining said front panel and a respective one of said straps, said first and second means crossing and being secured together adjacent a respective one side of the wearer, each of said first and second means having spaced apart longitudinal edges and a bight portion between said longitudinal edges, said first and second means being joined together along each longitudinal edge where said longitudinal edges cross.

* * * * *